US006641417B2

(12) United States Patent
Tanaka et al.

(10) Patent No.: US 6,641,417 B2
(45) Date of Patent: Nov. 4, 2003

(54) TERMINAL FITTING

(75) Inventors: Nobuyoshi Tanaka, Yokkaichi (JP); Kiyofumi Ichida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/152,304

(22) Filed: May 20, 2002

(65) Prior Publication Data

US 2002/0182914 A1 Dec. 5, 2002

(30) Foreign Application Priority Data

Jun. 4, 2001 (JP) ..... 2001-168598

(51) Int. Cl.[7] ..... H01R 13/52
(52) U.S. Cl. ..... 439/205; 439/271; 439/587
(58) Field of Search ..... 439/271, 276, 439/587, 589, 936, 205

(56) References Cited

U.S. PATENT DOCUMENTS 4,662,692 A * 5/1987 Uken et al. ..... 439/936
6,120,324 A 9/2000 Murayama et al.
6,149,456 A * 11/2000 Uchiyama ..... 439/936
6,171,145 B1 * 1/2001 Murayama ..... 439/936
6,193,536 B1 * 2/2001 Sanuki ..... 439/271
6,361,341 B1 * 3/2002 Okayasu et al. ..... 439/271
6,368,131 B1 * 4/2002 Takeuchi et al. ..... 439/271

FOREIGN PATENT DOCUMENTS

JP 2000-348816 12/2000

* cited by examiner

*Primary Examiner*—Gary Paumen
(74) *Attorney, Agent, or Firm*—Anthony J. Casella; Gerald E. Hespos

(57) ABSTRACT

A watertight connector has male and female housings (10, 20). The male housing (20) has a receptacle (21) and a gelatinous material accommodating space (23) rearward of the receptacle (21). A gelatinous material (30) is accommodated in the gelatinous material accommodating space (23). A leading end (14) of a female housing (11) is fittable into the receptacle (21). A slanted surface (25) is formed on an inner peripheral surface (24) of the receptacle (21) continuous with the gelatinous material accommodating space (23) over the entire periphery of the inner peripheral surface (24) to define an escaping space (26). The gelatinous material (30) is squeezed by the leading end (14) of the female housing and enters the escaping space (26).

12 Claims, 3 Drawing Sheets

TERMINAL FITTING

BACKGROUND OF THE INVENTION

1. Field of the Invention

The invention relates to a watertight connector that uses a gelatinous material.

2. Description of the Related Art

A watertight connector that uses a gelatinous material is known, for example, from Japanese Unexamined Patent Publication No. 2000-348816. This watertight connector has a male housing with a receptacle and a female housing. A gelatinous material is provided in a gelatinous material accommodating space at the back surface of the receptacle of the male housing. The gelatinous material is squeezed between the gelatinous material accommodating space and the leading end of the female housing when the housings are connected. Thus, the gelatinous material flows to seal clearances between the housings for achieving a watertight fit. However, the squeezing of the gelatinous material increases the connection resistance, and thus leads to a poor operability. The present invention was developed in view of the above problem and an object thereof is to provide a watertight connector having an improved operability.

SUMMARY OF THE INVENTION

The invention is directed to a watertight connector that has a first housing and a second housing with a receptacle into which the first housing can be fit. A gelatinous material accommodating space is provided at a back surface of the receptacle, and a gelatinous material is accommodated in the gelatinous material accommodating space. The gelatinous material is squeezed as the two housings are connected with each other to provide a watertight fit. An escaping space is formed between an outer surface of the first housing and an inner surface of the receptacle and is continuous with the gelatinous material accommodating space. Thus, the gelatinous material is squeezed during the connection of the two housings and can at least enter the escaping space.

The prior art watertight connector has a small clearance continuous with the gelatinous material accommodating space. However, the clearance is only sufficiently large to permit the connection of the two housings. Thus, the gelatinous material is squeezed as the housings are connected and is pressed in this small clearance. Resistance from the flow of the gelatinous material becomes excessively large, which further leads to a large connection resistance of the two housings. In contrast, the watertight connector of the invention permits the gelatinous material to escape into the escaping space. As a result, resistance caused by the gelatinous material is reduced and operability is improved. Thus, the invention provides a watertight connector with a smaller connection resistance despite a construction in which the housings squeeze the gelatinous material during connection.

The escaping space is formed by a clearance between the inner surface of the receptacle and the outer surface of the first housing over substantially the entire peripheral surfaces. Thus, the gelatinous material enters the escaping space over substantially the entire peripheral surfaces during connection of the housings, thereby providing satisfactory sealing over substantially the entire periphery of the front surface of the first housing.

The escaping space may be formed by a slanted surface on the inner peripheral surface of the receptacle that is widened toward an opening side of the receptacle. Thus, the gelatinous material can be accommodated easily into the gelatinous material accommodating space without getting caught.

The gelatinous material accommodating space may have an extension along a longitudinal direction of the watertight connector that is smaller than the thickness of the gelatinous material in an uncompressed state.

The gelatinous material accommodating space may have a volume smaller than the volume of the gelatinous material in an uncompressed state so that the gelatinous material can project out from the gelatinous material accommodating space. Accordingly, a squeezing effect can be improved, since the gelatinous material already projects from the gelatinous material accommodating space in an uncompressed state.

The gelatinous material accommodating space may be slightly larger than a leading end of the first housing. Accordingly, the first housing can be inserted into the gelatinous material accommodating space to improve the squeezing and the waterproofing.

The second connector housing preferably has at least one terminal fitting that can pierce through the gelatinous material accommodating space before the first housing is mated.

The first housing may comprise a base with an outer surface that is cross-sectionally slightly smaller than an inner surface of the receptacle.

Accordingly, the outer shape of the base end is formed to minimize the clearance between the base end and the inner peripheral surface. Thus, the connectors can be guided smoothly during connection and are shaken to a smaller degree.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
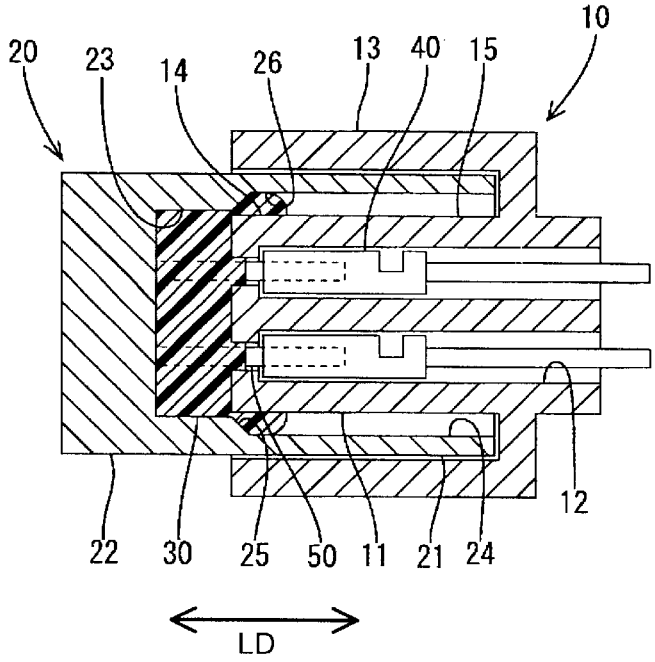
FIG. 1 is a section showing a connected state of two connectors according to one preferred embodiment of the invention.
Figure 2:
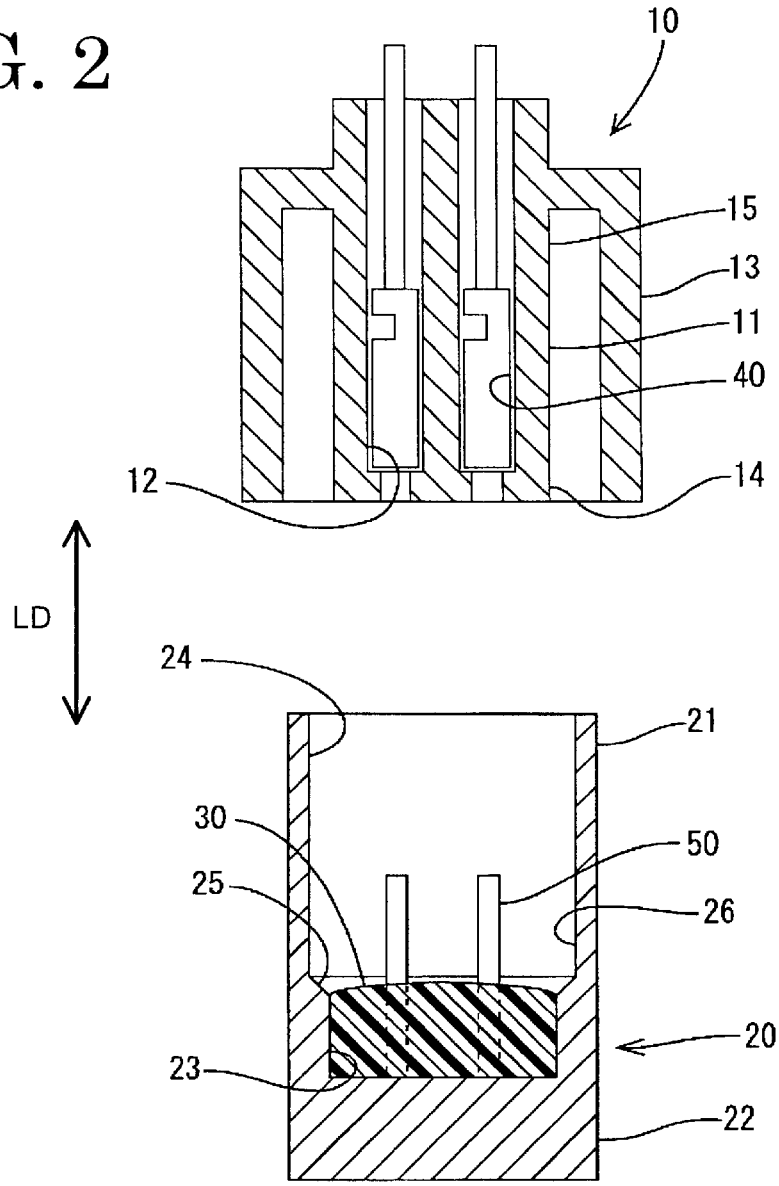
FIG. 2 is a section showing a state before the two connectors are connected.
Figure 3:
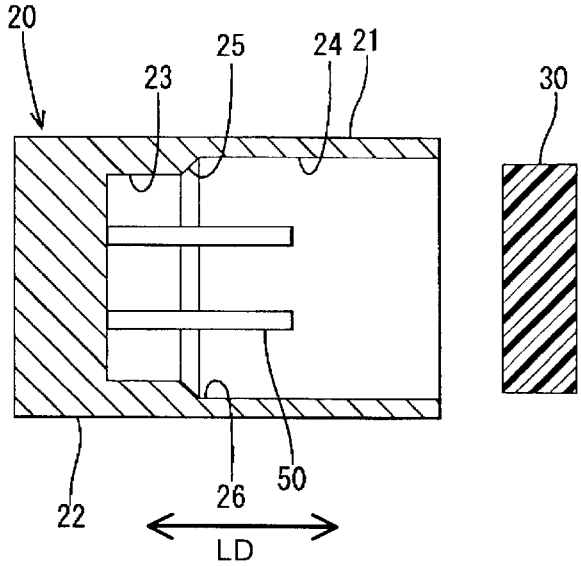
FIG. 3 is a section of the male connector before a gelatinous material is mounted.

A watertight or waterproof connector according to the invention has female and male connectors 10, 20 that can be mated to one another, as shown in FIGS. 1 to 3. The mating surface of each connector 10, 20 is referred to as the front in the following description. The waterproof connector may be used in an environment that requires waterproofing, and also in environments that require sealing against other types of fluids.

The male connector 20 is formed with a gelatinous material accommodation space 23 in which a gelatinous material 30 is disposed. A substantially plate-shaped gelatinous material 30 is accommodated in the gelatinous material accommodation space 23 and is held substantially close to the surrounding walls of the accommodation space 30 when the gelatinous material 30 in its natural state where no force acts thereon. The gelatinous material may be a gel, elastic or rubbery material containing three-dimensional cross-linked molecular formations or can behave as if it contained such molecular formations (geloids). One example of a gel that can be used is silicone gel or resin. Another suitable gel comprises a block copolymer having relatively hard blocks (e.g. hydrogenated rubber blocks). Such copolymers include styrene-diene block copolymers (linear or radial) for example styrene-butadiene or styrene-isoprene diblock or triblock copolymers, or styrene-ethylene-butylene-styrenes triblock copolymers. The gel may be formed from a single liquid material which becomes a gel when subjected e.g. to radiation or chemicals. The gel also may be formed from two components that become a gel when mixed; or the gel may be a composition that is a gel at working temperature, e.g. room temperature. Additionally or alternatively the gel material disclosed in U.S. Pat. No. 4,875,870 may be used.

The female connector 10 has a female housing 11 and cavities 12 that penetrate the female housing 11 in forward and backward or longitudinal directions LD, as shown in FIGS. 1 and 2. A female receptacle 13 surrounds forward portions of the female housing 11. Female terminal fittings 40 are inserted into the respective cavities 12 of the female housing 11, and a lock (not shown) is formed in each cavity 12 for locking the corresponding female terminal fitting 40.

The male connector 20 has a male receptacle 21 formed into a male housing 22 and the female housing 11 is fittable into the male receptacle 21. Male terminal fittings 50 project from a back surface of the male receptacle 21 and are connectable with the female terminal fittings 40 when the two connectors 10, 20 are connected with each other.

A gelatinous material accommodating space 23 is formed at the back or bottom side of the male receptacle 21, and the gelatinous material 30 is mounted therein. The gelatinous material 30 preferably is made of a silicone gel or other material that allows a plastic and/or elastic deformation when subjected to a pressure or force. Additionally, the gelatinous material 30 is larger or thicker than the gelatinous material accommodating space 23. In other words, an extension of the gelatinous material accommodating space 23 along the longitudinal direction LD is shorter than a thickness of the gelatinous material 30 measured along the direction LD when the gelatinous material 30 is in an uncompressed or unsqueezed state. Also, the volume of the gelatinous material accommodating space 23 may be smaller than the volume of the gelatinous material 30 in an uncompressed or unsqueezed state. The gelatinous material accommodating space 23 is cross sectionally slightly larger than a leading end 14 of the female housing 11, so that the leading end 14 is at least partly fittable therein.

The male receptacle 21 includes an inner peripheral surface 24 continuous with the gelatinous material accommodating space 23. A slanted surface 25 is formed substantially over the entire periphery and is widened toward the front side of the male receptacle 21. In this way, an escaping space 26 is formed by a clearance between the slanted surface 25 and the female housing 11 over the entire periphery of the female housing 11. Thus, the escaping space 26 is defined at a position out from the female housing 10.

Although not shown, the two connectors 10, 20 are provided with a known locking means comprised of, for example, a lock arm and a projection engageable with the lock arm. Thus, the two connectors 10, 20 can be locked sealed up just as they are connected with each other.

The gelatinous material 30 is pushed into the male receptacle 21 and is first pierced by the male terminal fittings 50. The gelatinous material 30 then is guided smoothly by the slanted surface 25 into the gelatinous material accommodating space 23.

The connection of the female and male terminal fittings 40, 50 is started by pushing the female housing 11 into the male receptacle 21. Thus, the leading end portion 14 of the female housing 11 is fitted into the gelatinous material accommodating space 23 at the end and squeezes the gelatinous material 30 in the gelatinous material accommodating space 23. As a result, the squeezed gelatinous material 30 flows to substantially all the corners in the gelatinous material accommodating space 23 and enters the escaping space 26 that is substantially continuous with the gelatinous material accommodating space 23. Thus, sealing is provided between the housings 11, 22. More particularly, satisfactory sealing can be provided over the entire periphery of the male connector housing 21 (see FIG. 1) because the escaping space 26 is defined over the entire outer periphery of the female housing 11.

The escaping space 26 is continuous with the gelatinous material accommodating space 23, and the gelatinous material 30 enters the escaping space 26 during the connection of the two connectors 10, 20. Thus, a pressure exerted on the gelatinous material 30 during the connection of the two connectors 10, 20 escapes to reduce connection resistance. As a result, a connecting operation can be performed more easily performed. More particularly, the escaping space 26 is formed substantially over the entire periphery of the female housing 11. Thus, the gelatinous material 30 enters the escaping space 26 substantially over the entire periphery during connection of the two housings 11, 22, thereby providing a satisfactory sealing.

The present invention is not limited to the above described and illustrated embodiment. For example, following embodiments are also embraced by the technical scope of the present invention as defined by the claims. Beside the following embodiments, various changes can be made without departing from the scope and spirit of the present invention as defined by the claims.

Figure 4:
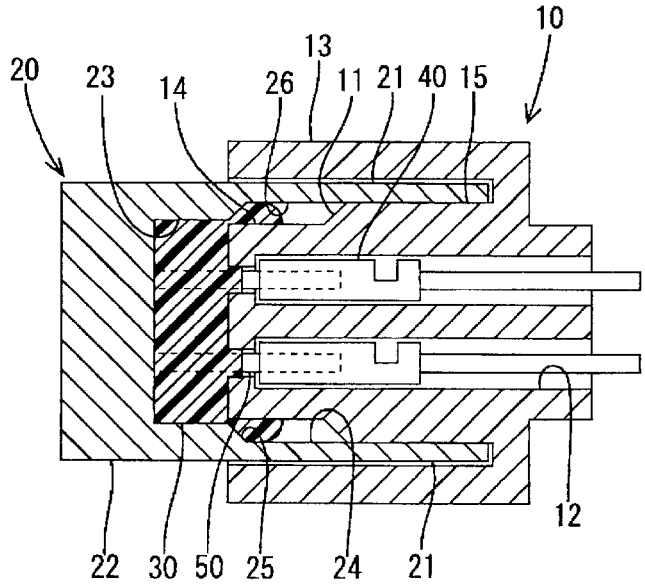
FIG. 4 is a section showing a connected state of two connectors according to another preferred embodiment.

In the foregoing embodiment, the leading and base ends 14 and 15 of the female housing 11 have outer shapes of the same dimensions, so that a clearance is defined between the base end portion 15 and the inner peripheral surface 24 of the male receptacle 21. However, the invention is not limited to such an embodiment. For example, the outer shape of the base end 15 may be larger, as shown in FIG. 4, to minimize the clearance between the base end 15 and the inner periphery 24. Then, the two connectors 10, 20 can be guided smoothly during their connection while being shaken to a smaller degree.

Although the escaping space 26 has a slanted surface 25 radially widened toward the front side in the foregoing embodiment, the slanted surface 25 is not necessarily essential. For example, the inner circumferential surface 24 of the male receptacle 21 may be stepped to be radially widened.

Even though the escaping space 26 is shown to be substantially continuous with the gelatinous material accommodating space 23 over substantially the entire circumference, it should be understood that they may also communicate over part of the circumference, only, i.e. only one or more azimuthal portions of the escaping space 26 are substantially continuous with the gelatinous material accommodating space 23.

Even though it is preferred that all the gelatinous material 30 squeezed out of the gelatinous material accommodating space 23 defined in the receptacle 21 is squeezed into the escaping space 26, some of the gelatinous material 30 may be squeezed out into other space(s) and in a position spaced from the female connector housing 10.

What is claimed is:

1. A watertight connector, comprising:

a first housing (10) having an outer peripheral surface;

a second housing (20) having a front end and a receptacle (21) adjacent the front end, the receptacle (21) having an inner peripheral surface, a gelatinous material accommodating space (23) being formed in the second housing (20) adjacent the receptacle (21), the first housing (10) being accommodated in the receptacle (21) and substantially adjacent the gelatinous material accommodating space (23), the first and second housings (10, 20) being dimensioned such that an escaping space (26) is defined between the inner and outer peripheral surfaces, the escaping space (26) being adjacent to and continuous with the gelatinous material accommodating space (23);

a gelatinous material (30) being disposed in the gelatinous material accommodating space (23) and being squeezed into the escaping space (26) as the two housings (10, 20) are connected with each other to provide watertightness.

2. The watertight connector of claim 1, wherein the receptacle (21) is between the front end and the gelatinous material accommodating space (23).

3. The watertight connector of claim 1, wherein the escaping space (26) is formed by a clearance defined between an inner circumferential surface (24) of the receptacle (21) and an outer circumferential surface of the first housing (10) over substantially the entire outer peripheral surface of the first housing (10).

4. The watertight connector of claim 1, wherein the escaping space (26) is formed by a slanted surface (25) on the inner peripheral surface (24) of the receptacle (21) that is widened toward the front of the receptacle (21).

5. The watertight connector of claim 1, wherein the gelatinous material accommodating space (23) has an extension along a longitudinal direction (LD) of the watertight connector which is smaller than a thickness of the gelatinous material (30) in an uncompressed state.

6. The watertight connector of claim 1, wherein the gelatinous material accommodating space (23) has a volume which is smaller than a volume of the gelatinous material (30) in an uncompressed state so that the gelatinous material (30) extends out from the gelatinous material accommodating space (23).

7. The watertight connector of claim 1, wherein the gelatinous material accommodating space (23) is cross-sectionally slightly larger than a leading end portion (14) of the first connector housing (10).

8. The watertight connector of claim 1, wherein the second housing (20) has at least one terminal fitting (50) that pierces through the gelatinous material (30) in the gelatinous material accommodating space (23).

9. The watertight connector of claim 1, wherein the first housing (10) comprises a base end (15) with an outer periphery inward position more inward than the inner peripheral surface (24) of the receptacle (21).

10. A watertight connector, comprising:

a first housing (10) having a front end and an outer peripheral surface extending rearward of the front end, the outer peripheral surface defining a first cross-sectional size and shape;

a second housing (20) having a front end and a receptacle (21) adjacent the front end, the receptacle (21) having an inner peripheral surface defining a second cross-sectional size and shape, a gelatinous material accommodating space (23) being formed in the second housing (20) adjacent and rearward of the receptacle (21), the gelatinous material accommodating space (23) having a selected volume and having a third cross-sectional size and shape that is larger than the first cross-sectional size and shape of the first housing (10), but smaller than the second cross-sectional size and shape of the receptacle (21);

a gelatinous material (30) with a volume greater than the gelatinous material accommodating space (23) being disposed in the gelatinous material accommodating space (23) and extending partly into the receptacle (21), whereby the gelatinous material (30) is squeezed into an escaping space (26) between the inner and outer peripheral surfaces as the two housings (10, 20) are connected with each other to provide watertightness.

11. The watertight connector of claim 10, further comprising an outwardly slanted surface (25) extending from the gelatinous accommodating space (23) to the inner peripheral surface (24) of the receptacle (21).

12. The watertight connector of claim 11, wherein the second housing (20) has at least one terminal fitting (50) that pierces through the gelatinous material (30) in the gelatinous material accommodating space (23).

* * * * *